US011009032B2

(12) United States Patent
Horii et al.

(10) Patent No.: US 11,009,032 B2
(45) Date of Patent: May 18, 2021

(54) CENTRIFUGAL FAN

(71) Applicant: NIDEC CORPORATION, Kyoto (JP)

(72) Inventors: Yuya Horii, Kyoto (JP); Tsuyoshi Yasumura, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 193 days.

(21) Appl. No.: 16/137,544

(22) Filed: Sep. 21, 2018

(65) Prior Publication Data

US 2019/0101124 A1 Apr. 4, 2019

(30) Foreign Application Priority Data

Sep. 29, 2017 (JP) ..... JP2017-191581

(51) Int. Cl.

| | |
|---|---|
| ***F04D 25/06*** | (2006.01) |
| ***F04D 29/42*** | (2006.01) |
| ***F04D 29/58*** | (2006.01) |
| ***F04D 29/28*** | (2006.01) |

(52) U.S. Cl.

CPC ..... *F04D 25/0606* (2013.01); *F04D 25/064* (2013.01); *F04D 25/0613* (2013.01); *F04D 29/281* (2013.01); *F04D 29/4226* (2013.01); *F04D 29/5813* (2013.01)

(58) Field of Classification Search

CPC ..... F04D 25/064; F04D 25/0606; F04D 25/0613; F04D 29/281; F04D 29/4226; F04D 29/5813

USPC ..... 417/423.14

See application file for complete search history.

(56) References Cited

U.S. PATENT DOCUMENTS

| | | | | |
|---|---|---|---|---|
| 4,428,719 | A * | 1/1984 | Hayashibara | F04D 25/0606 417/354 |
| 4,773,829 | A * | 9/1988 | Vettori | H02K 7/14 310/68 R |
| 7,453,696 | B2 * | 11/2008 | Tungl | F04D 25/0606 361/695 |
| 8,647,079 | B2 * | 2/2014 | Aoki | F04D 29/4213 361/695 |
| 9,494,161 | B2 | 11/2016 | Yoneda et al. | |
| 9,885,367 | B2 * | 2/2018 | Suzuki | F04D 29/666 |

(Continued)

FOREIGN PATENT DOCUMENTS

| | | |
|---|---|---|
| CN | 202926712 U | 5/2013 |
| CN | 203589927 U | 5/2014 |
| JP | 2009114906 A | 5/2009 |

*Primary Examiner* — Christopher S Bobish

(74) *Attorney, Agent, or Firm* — Hauptman Ham, LLP

(57) ABSTRACT

A centrifugal fan includes a motor, an impeller, a circuit board, and a casing. The motor has a stator and a rotatable rotor. The impeller is fixed to and rotates with the rotor. The casing has a lower casing recessed downward and provided with a board housing portion accommodating the circuit board. The impeller includes a boss portion, blade portions, an upper shroud, and a lower shroud. The blade portions are disposed at intervals in the circumferential direction on an outer peripheral surface of the boss portion and extend radially outside. The upper shroud is connected to at least a portion of each of the blade portions on the upper side. The lower shroud is connected to at least a portion of the blade portion on the lower side. At least a portion of the lower end surface of the blade portion faces the upper surface of the circuit board.

16 Claims, 8 Drawing Sheets

(56) References Cited

U.S. PATENT DOCUMENTS

| | | | | |
|---|---|---|---|---|
| 2007/0014675 | A1* | 1/2007 | Nagamatsu | F04D 25/0613 417/354 |
| 2007/0098571 | A1* | 5/2007 | Nagamatsu | F04D 25/0613 417/354 |
| 2007/0128052 | A1* | 6/2007 | Moriya | F04D 25/0613 417/354 |
| 2008/0175729 | A1* | 7/2008 | Kato | F04D 29/646 417/353 |
| 2013/0004307 | A1 | 1/2013 | Fukuda et al. | |
| 2013/0052049 | A1 | 2/2013 | Fujimoto et al. | |
| 2013/0084173 | A1* | 4/2013 | Fukuda | F04D 29/30 415/203 |
| 2014/0044534 | A1* | 2/2014 | Yamasaki | F04D 29/30 415/206 |
| 2014/0134011 | A1* | 5/2014 | Chen | F04D 25/14 417/354 |
| 2015/0377238 | A1 | 12/2015 | Fujimoto et al. | |
| 2016/0025103 | A1 | 1/2016 | Fujimoto et al. | |
| 2017/0114791 | A1 | 4/2017 | Yamada et al. | |
| 2017/0224940 | A1* | 8/2017 | Kenyon | A61M 16/0605 |
| 2017/0284420 | A1 | 10/2017 | Nara et al. | |
| 2018/0003188 | A1 | 1/2018 | Nara et al. | |
| 2019/0389344 | A1* | 12/2019 | Ishii | F04D 29/281 |
| 2019/0390676 | A1* | 12/2019 | Ishii | F04D 29/4226 |

* cited by examiner

CENTRIFUGAL FAN

CROSS REFERENCE TO RELATED APPLICATIONS

The present application claims priority under 35 U.S.C. § 119 to Japanese Application No. 2017-191581 filed on Sep. 29, 2017 the entire contents of which are incorporated herein by reference.

FIELD

The present disclosure relates to a centrifugal fan.

BACKGROUND

A centrifugal fan has a structure in which an impeller having a plurality of blades arranged on the circumference thereof is accommodated between an upper casing in which an air intake port is formed and a lower casing. As the impeller rotates, the centrifugal fan discharges air introduced through an opening portion to a side of the impeller. The lower casing is a metal plate and has a recessed portion recessed downward. A motor is attached to a bottom surface of the recessed portion. A portion of a stator of the motor and a circuit board on which a drive circuit of the motor is mounted are accommodated in the recessed portion. The recessed portion is provided with a hole portion through which a supplier that supplies electric power for rotating the motor passes.

In a configuration in which impeller blade portions are between an upper shroud and a lower shroud, in the case where the impeller is formed as a single member, a lateral slide mechanism is used for the mold and the mold structure becomes complicated. In addition, there is a restriction that an undercut portion in the vicinity of the air intake port is provided. On the other hand, in the case where the impeller is formed of two members, geometrical problems that arises when the impeller is formed as a single member are able to be reduced or solved. However, the difficulty of manufacturing an impeller formed as two members increases because two molds are used and a method, such as welding, for fastening the two members is also used.

On the other hand, in high-output motors, because the electronic components used are becoming larger, the size of the circuit board increases in accordance with the increase in the size of the electronic components. In the case where a circuit board is made larger, with the configuration of the existing centrifugal fan, the recessed portion is enlarged for accommodating the circuit board. As a result, a space is generated between the peripheral edge of the recessed portion and the impeller, and the wind guiding function of the lower casing is reduced or lost. Thus, there is a possibility that static pressure characteristics, air volume characteristics, and noise characteristics deteriorate when the circuit board is increased in size.

As a countermeasure against this, in some instances the space between the peripheral portion of the recessed portion and the impeller is filled by extending the lower shroud of the impeller radially outside. However, in this method, an undercut portion is generated in the upper shroud and the lower shroud, which causes a problem that the mold structure becomes complicated in some instances. In addition, the height of the blade portions is shortened and there is a possibility that the airflow rate in a thin centrifugal fan decreases.

SUMMARY

A centrifugal fan according to at least one aspect of the present disclosure includes a motor that has a stator and a rotor rotatable with respect to the stator. The centrifugal fan further includes an impeller that is fixed to the rotor and that rotates together with the rotor. The centrifugal fan further includes a circuit board that is electrically connected to the motor. The centrifugal fan further includes a casing that accommodates the motor, the impeller, and the circuit board. The casing has a lower casing recessed downward in an axial direction and includes a board housing portion that accommodates the circuit board. The impeller includes a boss portion having a cylindrical shape and fixed to the rotor. The impeller further includes a plurality of blade portions that are arranged at intervals in a circumferential direction on an outer peripheral surface of the boss portion and that extend toward outside in a radial direction. The impeller further includes an upper shroud having an annular shape and connected to at least a portion of each of the blade portions on an upper side in the axial direction and a lower shroud having an annular shape and connected to at least a portion of the blade portion on a lower side in the axial direction. At least a portion of a lower end surface of the blade portion opposes an upper surface of the circuit board in the axial direction. In at least one embodiment the impeller has a structure that enables mold pieces to be removed in the up-and-down direction and the impeller is formed as a single member.

The above and other elements, features, steps, characteristics and advantages of at least one embodiment of the present disclosure will become more apparent from the following detailed description of embodiments with reference to the attached drawings.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 2:
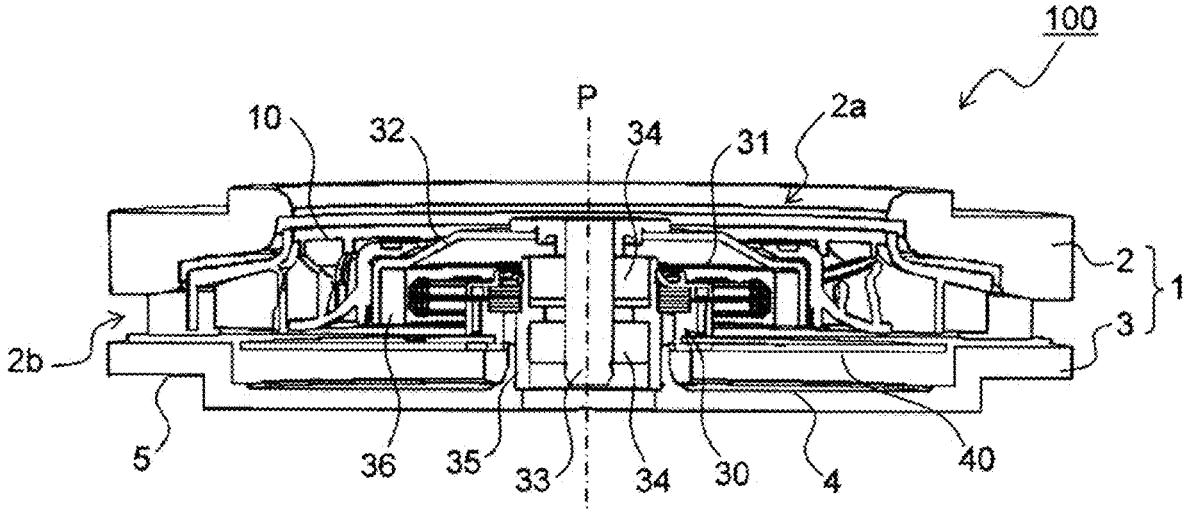
FIG. 2 is a side cross-sectional view of a centrifugal fan according to at least one embodiment of the present disclosure.

The following disclosure provides many different embodiments, or examples, for implementing different features of the provided subject matter. Specific examples of components, values, operations, materials, arrangements, or the like, are described below to simplify the present disclosure. These are, of course, merely examples and are not intended to be limiting. Other components, values, operations, materials, arrangements, or the like, are contemplated. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed. Further, in this specification, the direction parallel to the central axis P of a centrifugal fan 100 in FIG. 2 is referred to as "the axial direction", the direction orthogonal to the central axis P is referred to as "the radial direction", and the direction along an arc with the central axis P as the center is referred to as "the circumferential direction". In addition, the shape and positional relationship of each element will be described with the direction in which the central axis P extends as the up-and-down direction, the side of an impeller 10 as the upward direction, and the side of a motor 30 as the downward direction. However, in practicality, there is no intention to limit the orientation during use of the centrifugal fan 100 to this definition of the up-and-down direction.

In addition, in the present disclosure, "parallel direction" also includes a substantially parallel direction. A substantially parallel direction is a direction offset from parallel, where the offset is not sufficient to alter the performance of the device. In addition, in the present disclosure, "perpendicular direction" also includes a direction that is substantially perpendicular. A substantially perpendicular direction is a direction offset from perpendicular, where the offset is not sufficient to alter the performance of the device.

Figure 1:
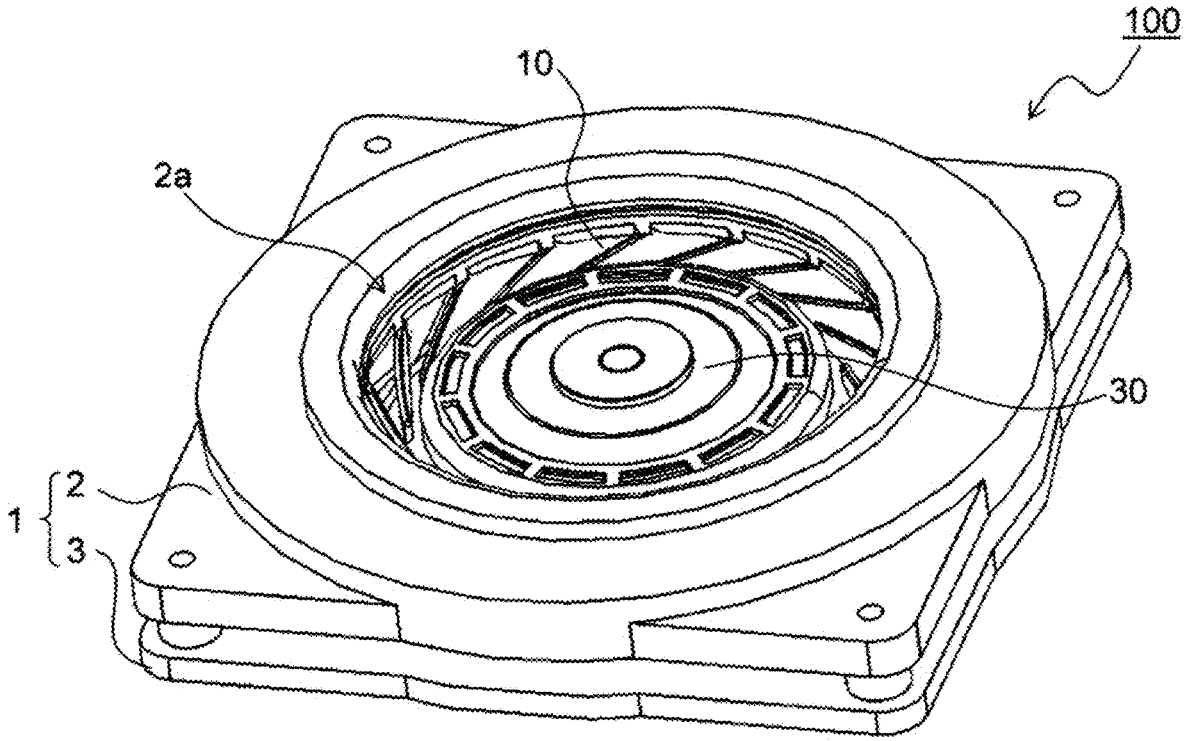
FIG. 1 is an external perspective view of a configuration of a centrifugal fan according to at least one embodiment of the present disclosure.
Figure 3:
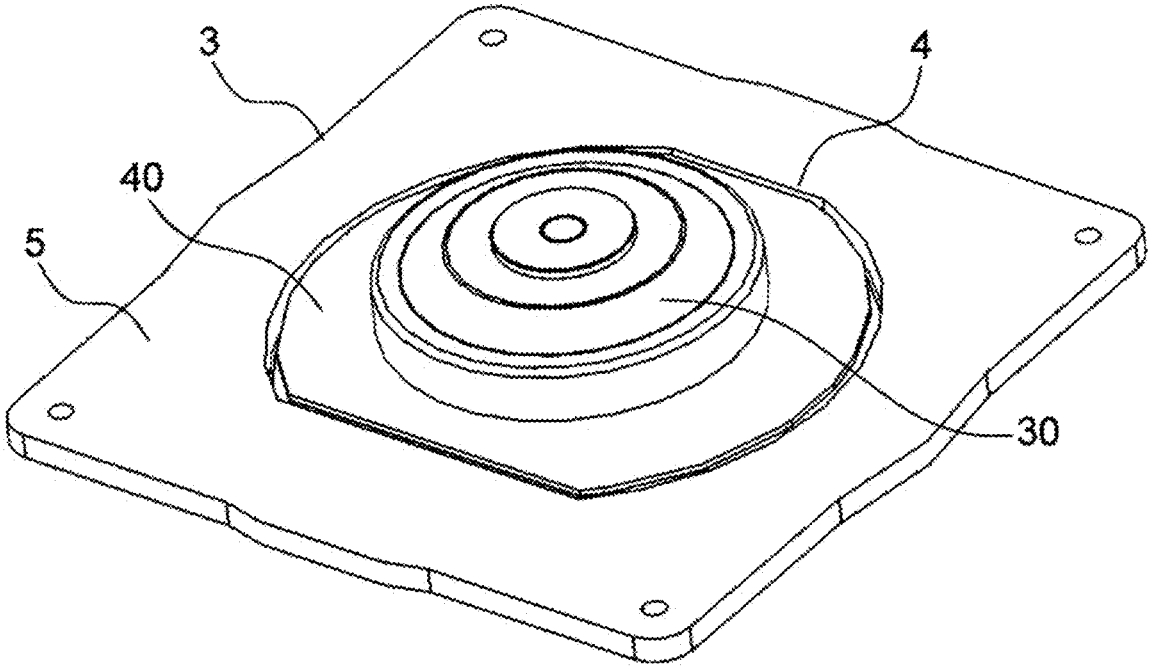
FIG. 3 is a perspective view of a centrifugal fan in which the upper casing and the impeller are removed from the centrifugal fan according to at least one embodiment of the present disclosure.

FIG. 1 is an external perspective view of a configuration of a centrifugal fan 100 according to at least one embodiment of the present disclosure. FIG. 2 is a side cross-sectional view of the centrifugal fan 100 according to at least one embodiment of the present disclosure. FIG. 3 is a perspective view of a centrifugal fan in which an upper casing 2 and the impeller 10 are removed from the centrifugal fan 100 according to at least one embodiment of the present disclosure. In FIG. 1 and FIG. 2, the centrifugal fan 100 includes a casing 1, the impeller 10, the motor 30, and a circuit board 40.

The casing 1 accommodates the impeller 10, the motor 30, and the circuit board 40. The casing 1 has the upper casing 2 and a lower casing 3. The upper casing 2 covers the upper side of the impeller 10 in the axial direction and has an intake port 2*a*. In at least one embodiment, the intake port 2*a* is circular and opposes the center portion of the impeller 10 in the radial direction. The lower casing 3 accommodates the motor 30 and the circuit board 40. The lower casing 3 has a board housing portion 4 and a flange portion 5 extending outside in the radial direction from the peripheral edge of the board housing portion 4. The board housing portion 4 is recessed downward in the axial direction from the impeller 10 and accommodates the circuit board 40. The board housing portion 4 has a similar shape as the circuit board 40 and is slightly larger in the radial direction than the circuit board 40. In at least one embodiment, the board housing portion 4 has a same shape as the circuit board 40. The motor 30 is positioned at the center portion of the board housing portion 4 in the radial direction, and the circuit board 40 is arranged surrounding the motor 30 in the radial direction.

The motor 30 has a stator 31, a rotor 32, a shaft 33, a bearing portion 34, and a bearing holding portion 35. The rotor 32 is disposed on the upper side of the stator 31 and on the outer side of the stator in the radial direction. The rotor 32 has a downward facing cup-shaped opening. The impeller 10 is fixed to the outer side of the rotor 32. The shaft 33 is fixed to the radial center portion of the rotor 32. A rotor magnet 36 is fixed to the inner peripheral surface of the rotor 32. In at least one embodiment, the rotor magnet 36 is a single annular magnet. N poles and S poles are alternately magnetized in the circumferential direction on the radially inner surface of the rotor magnet 36. In at least one embodiment, the rotor magnet 36 includes a plurality of magnets arranged on the inner peripheral surface of the rotor 32.

The shaft 33 is a columnar member arranged along the central axis P of the centrifugal fan 100. The shaft 33 includes, in at least one embodiment, a metal, such as stainless steel, or another suitable material. An upper end portion of the shaft 33 is located above the bearing portion 34 on the upper side. The upper end portion of the shaft 33 is fixed to a rotor hole penetrating in the axial direction along the central axis P of the rotor 32.

The bearing portion 34 rotatably supports the shaft 33 around the central axis P. The bearing holding portion 35 supports the stator 31 on an outer portion of the bearing hold portion 35 in the radial direction and supports the bearing portion 34 on an inner portion of the bearing hold portion 35 in the radial direction. The bearing holding portion 35 includes, in at least one embodiment, a metal, such as stainless steel brass or the like. The material of the bearing holding portion 35 is not limited to a metal and may be a resin or another suitable material. The bearing holding portion 35 extends in a cylindrical shape in the axial direction around the central axis P. The lower end portion of the bearing holding portion 35 is inserted into a circular hole provided in the central axis P of the lower casing 3 and is fixed to the lower casing 3.

The stator 31 is an armature that generates a magnetic flux according to the drive current. The stator 31 has a stator core, an insulator, and a coil.

The stator core is a magnetic body. For the stator core, in at least one embodiment, a laminated steel plate or the like may be used. The stator core has an annular core back and a plurality of teeth. The core back is fixed to the outer peripheral surface of the bearing holding portion 35. The plurality of teeth protrude radially outward from the core back. The insulator is an insulating body. As a material of the insulator, in at least one embodiment, a resin may be used. The insulator covers at least a portion of the stator core. The coil is formed of a conductor wound around the teeth with the insulator between the conductor and the teeth.

By supplying a drive current to the stator 31, a rotational torque is generated between the rotor magnet 36 and the stator 31. As a result, the rotor 32 rotates with respect to the stator 31, and the impeller 10, which is fixed to the rotor 32, also rotates around the central axis P. Further, the motor 30 in FIG. 2 is an outer-rotor-type motor in which the rotor 32 is disposed outside of the stator 31 in the radial direction. In at least one embodiment, an inner-rotor-type motor in which the rotor 32 is disposed inside of the stator 31 in the radial direction may be used for centrifugal fan 100.

The circuit board 40 is electrically connected to the motor 30 and supported outside the motor 30 in the radial direction. The circuit board 40 is disposed in the board housing portion 4 of the lower casing 3. The circuit board 40 is disposed substantially perpendicular to the central axis P on the upper side of the lower casing 3 and on the lower side of the stator 31. The circuit board 40 is, in at least one embodiment, fixed to an insulator. An electric circuit that supplies drive current to the coil is mounted on the circuit board 40. End portions of the conductor forming the coil are electrically connected to terminals provided on the circuit board 40.

Figure 4:
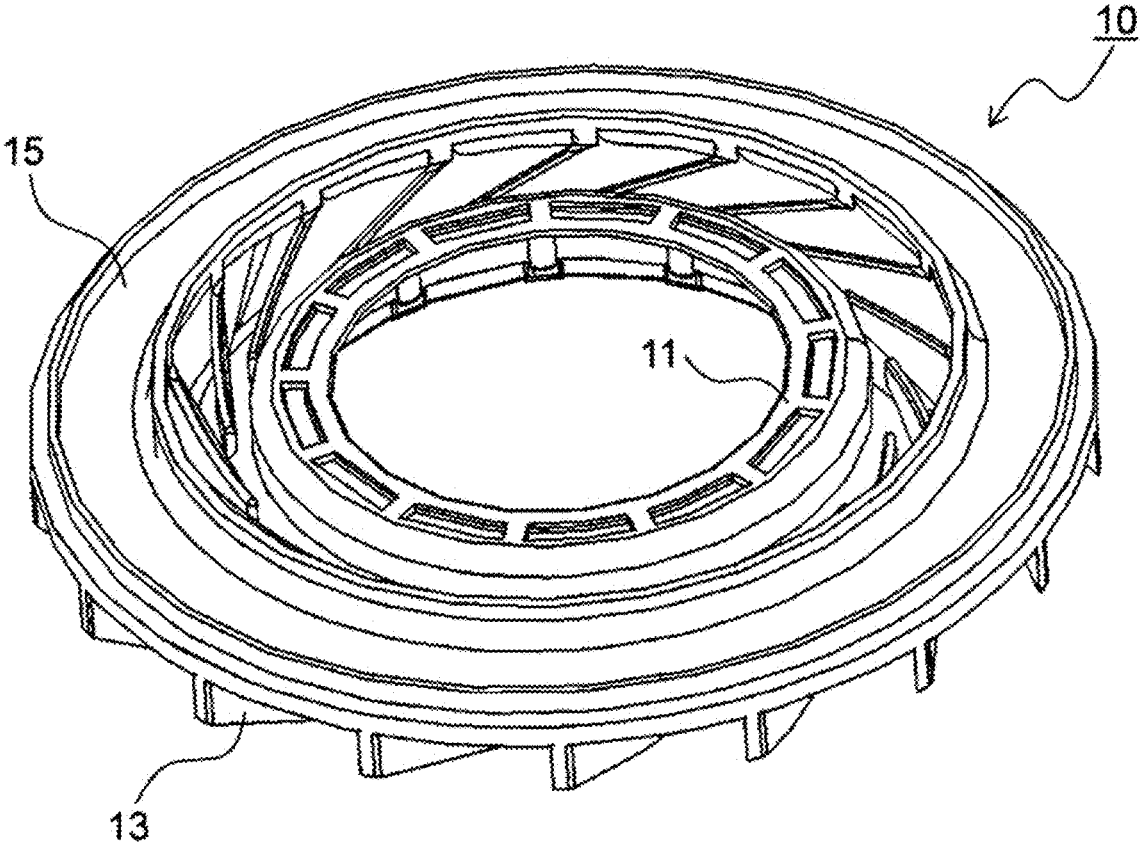
FIG. 4 is a top perspective view of an impeller according to at least one embodiment of the present disclosure.
Figure 5:
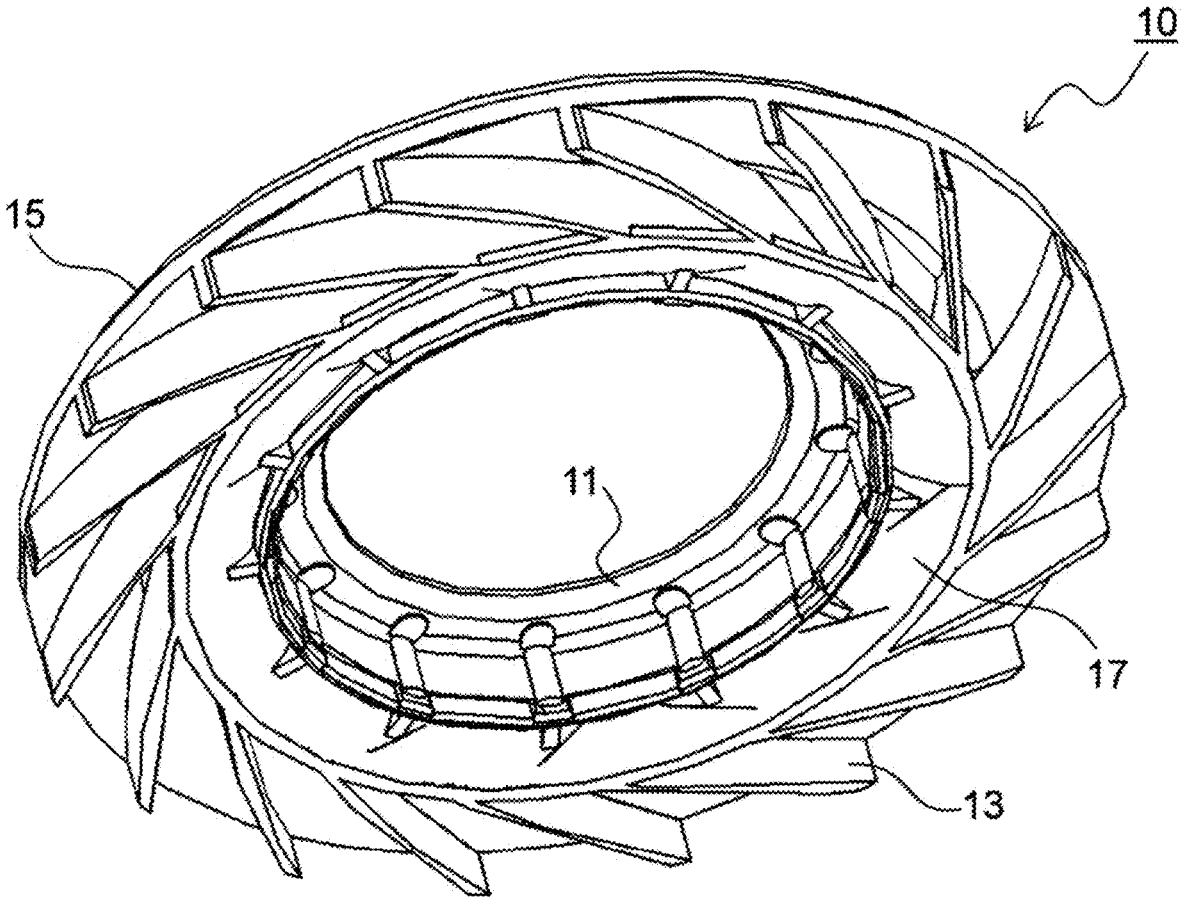
FIG. 5 is a bottom perspective view of an impeller according to at least one embodiment of the present disclosure.

FIG. 4 is a top perspective view of the impeller 10 according to at least one embodiment of the present disclosure. FIG. 5 is a bottom perspective view of the impeller 10 according to at least one embodiment of the present disclosure. The impeller 10 includes a boss portion 11, a plurality of blade portions 13, an upper shroud 15, and a lower shroud 17. The boss portion 11, the blade portions 13, the upper shroud 15, and the lower shroud 17 are a single member formed of a same material. In at least one embodiment, the boss portion 11, the blade portions 13, the upper shroud 15 and the lower shroud 17 are a resin material.

The boss portion 11 is cylindrical and is fixed to the outer peripheral surface of the rotor 32 on the upper side of the motor 30. The plurality of the blade portions 13 are arranged at intervals in the circumferential direction from the outer peripheral surface of the boss portion 11. In a plan view, the blade portions 13 are inclined in the same direction as the rotation direction of the centrifugal fan 100 and extend outward in the radial direction. Further, the direction in which the blade portions 13 extend is not limited to outward in the radial direction. In at least one embodiment, a portion of the blade portions 13 may extend in a direction opposite to the rotation direction. In at least one embodiment, a portion of the blade portions 13 may extend perpendicularly to the rotation direction. In at least one embodiment, a first portion of the blade portions 13 extend in the direction opposite to the rotation direction and a second portion of the blade portions 13 extend perpendicularly to the rotation direction. In some instances, the first portion of the blade portions 13 refers to an upper part of the blade portions 13; and the second portion of the blade portion refers to a lower part of the blade portions 13.

The upper shroud 15 is provided in an annular shape so as to be connected to at least a portion of each of the blade portions 13 on the upper side. In at least one embodiment, the upper shroud 15 is connected to an outer portion in the radial direction of the blade portions 13. The lower shroud 17 is provided in an annular shape so as to be connected to at least a portion of the blade portion 13 on the lower side. In at least one embodiment, the lower shroud 17 is connected to an inner portion in the radial direction of the blade portions 13.

Air sucked from the intake port 2*a* of the upper casing 2 is spun in the casing 1 in the circumferential direction by the rotation of the impeller 10 and is discharged from an exhaust port 2*b* provided between the upper casing 2 and the lower casing 3. The upper shroud 15 and the lower shroud 17 efficiently guide the air drawn into the casing 1 from the intake port 2*a* to the exhaust port 2*b*, thereby improving the fan efficiency of the centrifugal fan 100. In at least one embodiment, the exhaust port 2*b* is provided in the entire casing 1 in the circumferential direction. In at least one embodiment, the exhaust port 2*b* may be provided only in a portion of the casing 1 in the circumferential direction. In at least one embodiment, the exhaust port 2*b* includes a plurality of openings in casing 1. In at least one embodiment, the plurality of openings are spaced at regular intervals around the circumference of the casing 1.

Figure 6:
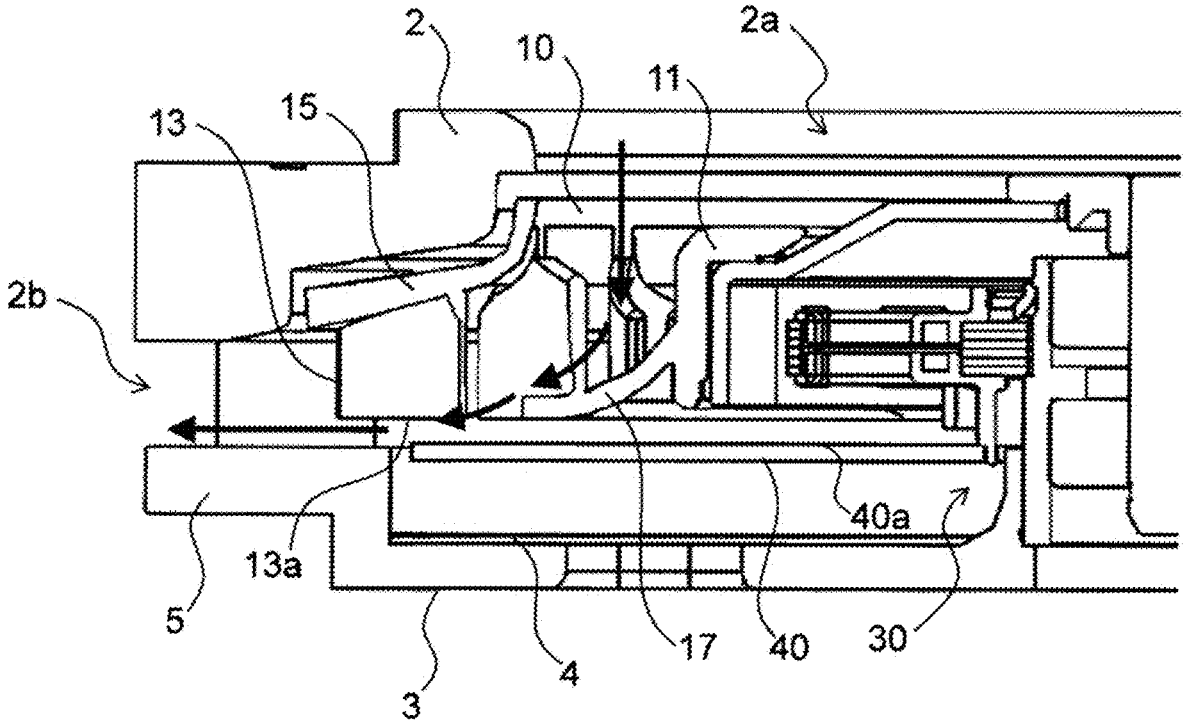
FIG. 6 is a partial cross-sectional view around an exhaust port of a centrifugal fan according to at least one embodiment of the present disclosure.
Figure 7:
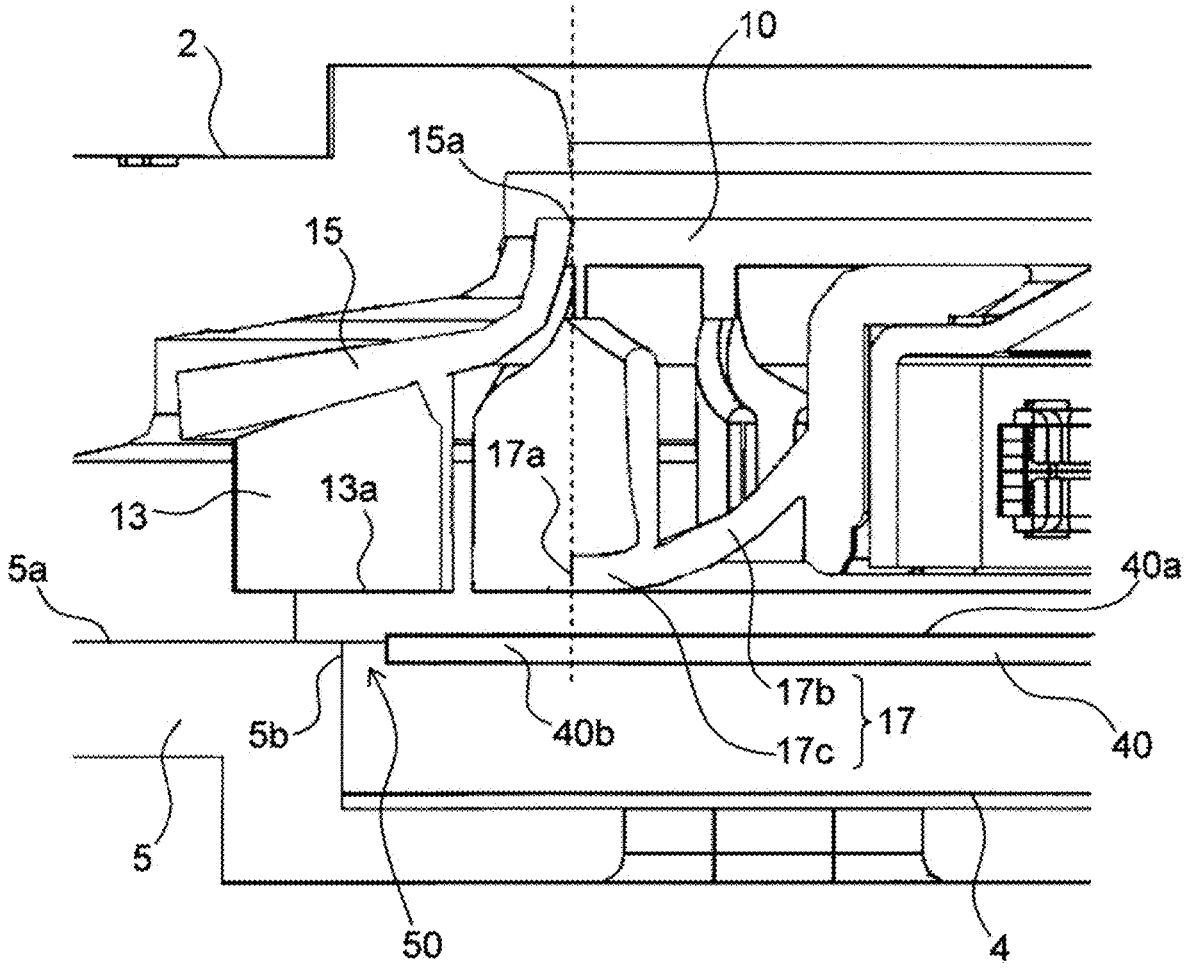
FIG. 7 is an enlarged partial cross-sectional view of a vicinity of an upper shroud and a lower shroud of the impeller according to at least one embodiment of the present disclosure.

Next, a configuration around the exhaust port 2*b*, which is a portion of the centrifugal fan 100 according to the at least one embodiment, will be described. FIG. 6 is a partial cross-sectional view around the exhaust port 2*b* of the centrifugal fan 100 according to at least one embodiment of the present disclosure. FIG. 7 is an enlarged cross-sectional view of the vicinity of the upper shroud 15 and the lower shroud 17 of the impeller 10 according to at least one embodiment of the present disclosure.

In FIG. 6, the rotor 32, the boss portion 11 and the blade portion 13 of the impeller 10 are disposed so as to overlap in the radial direction. The lower end surface of the rotor 32 and the lower end surface of the boss portion 11 are positioned above a lower end surface 13*a* of the blade portion 13 in the axial direction. Furthermore, by accommodating the height of the boss portion 11 in the axial direction within the height of the impeller 10 in the axial direction, the centrifugal fan 100 is thinner in comparison with other arrangements. Furthermore, the height of the stator 31 and the rotor magnet 36 in the axial direction is accommodated within the height of the impeller 10 in the axial direction. As a result, the centrifugal fan 100 thinner in comparison with other arrangements.

At least a portion of the lower end surface 13*a* of the blade portion 13 of the impeller 10, specifically, an inner portion of the lower end surface 13*a* of the blade portion 13 in the radial direction, opposes an upper surface 40*a* of the circuit board 40 in the axial direction. As a result, the airflow flowing in the axial direction from the intake port 2*a* and the gap between the outer peripheral surface of the boss portion 11 and the inner peripheral surface of the upper shroud 15 is guided along the upper surface 40*a* of the circuit board 40 in the centrifugal direction. That is, because the upper surface 40*a* of the circuit board 40 also serves as a portion of the flow path of the airflow, the casing 1 thinner in comparison with other arrangements.

In FIG. 7, a radially outer edge 17*a* of the lower shroud 17 is positioned further inside in the radial direction than a radially outer edge 40*b* of the circuit board 40. As a result, as indicated by the black arrow in FIG. 6, the air flowing in from the intake port 2*a* and along the lower shroud 17 is further turned toward the centrifugal direction and discharged from the exhaust port 2*b* on the upper surface 40*a* of the circuit board 40.

In addition, an upper surface 5*a* of the flange portion 5 of the lower casing 3 has the same height in the axial direction as the upper surface 40*a* of the circuit board 40. As a result, because the upper surface 5*a* of the flange portion 5 and the upper surface 40*a* of the circuit board 40 are positioned on the same plane, the airflow is smoothly discharged along the circuit board 40 and the flange portion 5 in the centrifugal direction. Further, the upper surface 5*a* of the flange portion 5 may be configured to be lower than the upper surface 40*a* of the circuit board 40. In this case, reduction of the airflow, the direction of which has been changed to the centrifugal direction along the upper surface 40*a* of the circuit board 40, as a result of hitting a radially inner edge 5*b* of the flange portion 5 is suppressed. That is, in at least one embodiment, the height of the upper surface 5*a* of the flange portion 5 may be equal to or less than the height of the upper surface 40*a* of the circuit board 40.

In at least one embodiment, a plurality of electronic components are arranged on the lower surface of the circuit board 40, which faces downward in the axial direction. The radially inner edge 5*b* of the flange portion 5 and the radially outer edge 40*b* of the circuit board oppose each other with a gap 50 therebetween, which is predetermined. The space above the circuit board 40 in the axial direction in which the impeller 10 is arranged communicates with the space in the board housing portion 4 located below the circuit board 40 in the axial direction via the gap 50. As a result, the airflow, the direction of which is changed to the centrifugal direction along the lower shroud 17 and the circuit board 40, passes through the gap 50 and flows into the space in the board housing portion 4 located between the circuit board 40 and the lower casing 3. Therefore, electronic components mounted on the lower surface of the circuit board 40 are cooled. Therefore, heat generation of the electronic components can be alleviated through convective heat transfer.

In addition, at least a portion of the lower end surface 13*a* of the blade portion 13, specifically, the radially outer portion of the lower end surface 13*a* of the blade portion 13 opposes the upper surface 5*a* of the flange portion 5 in the axial direction. That is, the lower end surface 13*a* of the blade portion 13 opposes the upper surface 40*a* of the circuit board 40 and the upper surface 5*a* of the flange portion 5 in the axial direction. The upper surface 40*a* of the circuit board 40 and the upper surface 5*a* of the flange portion 5 are continuously arranged in the horizontal direction and the blade portions 13 are arranged above the upper surface 40*a* of the circuit board 40 and the upper surface 5*a* of the flange portion 5. By extending the blade portions 13 to positions overlapping with the flange portion 5 in the axial direction, the amount of air generated by the rotation of the impeller 10 can be increased.

The lower shroud 17 has an inclined portion 17*b* and a flat portion 17*c*. The inner end of the inclined portion 17*b* in the radial direction is connected to the outer peripheral surface of the boss portion 11. The inclined portion 17*b* is inclined downward from inside toward outside in the radial direction. The flat portion 17*c* is formed continuously outside the inclined portion 17*b* in the radial direction and extends along a plane perpendicular to the axial direction. Because the lower shroud 17 has the inclined portion 17*b*, the airflow flowing in the axial direction from the intake port 2*a* can change its direction along the inclined portion 17*b* toward the upper surface of the circuit board 40. In addition, by providing the flat portion 17*c* continuously with the inclined portion 17*b*, the direction of the airflow to the centrifugal direction along the inclined portion 17*b*, the flat portion 17*c*, and the circuit board 40 is smoothly changed.

The radially outer edge 17*a* of the lower shroud 17 is located at the same position in the radial direction as a radially inner edge 15*a* of the upper shroud 15. As a result, separate mold pieces in the up-and-down direction when the impeller 10 is formed by injection molding with resin is avoided. Therefore, because a split mold and a slide mechanism for the mold are avoided, the structure of the mold and the manufacturing process can be simplified in comparison with other approaches. Further, the radially outer edge 17*a* of the lower shroud 17 may be located further inside in the radial direction than the radially inner edge 15*a* of the upper shroud 15. That is, as long as the radially outer edge 17*a* of the lower shroud 17 is located at the same position in the radial direction as the radially inner edge 15*a* of the upper shroud 15, or further inside in the radial direction than the radially inner edge 15*a* of the upper shroud 15, separate mold pieces in the up-and-down direction is avoided.

In order to simplify the mold structure and the manufacturing process of the impeller 10, by making the positional relationship between the radially outer edge 17*a* of the lower shroud 17 and the radially inner edge 15*a* of the upper shroud 15 as that described above, the length in the radial direction from the central axis P to the radially outer edge 17*a* of the lower shroud 17 is shortened and smooth flow of the airflow in the centrifugal direction is restricted. However, in at least one embodiment, because the lower end surface 13*a* of the blade portion 13 opposes the upper surface 40*a* of the circuit board 40 in the axial direction, the airflow that flows in the axial direction from the intake port 2*a* is guided along the upper surface 40*a* of the circuit board 40 in the centrifugal direction. That is, because the upper surface 40*a* of the circuit board 40 also serves as a portion of the flow path of the airflow, the casing 1 thinner in comparison with other arrangements.

Figure 8:
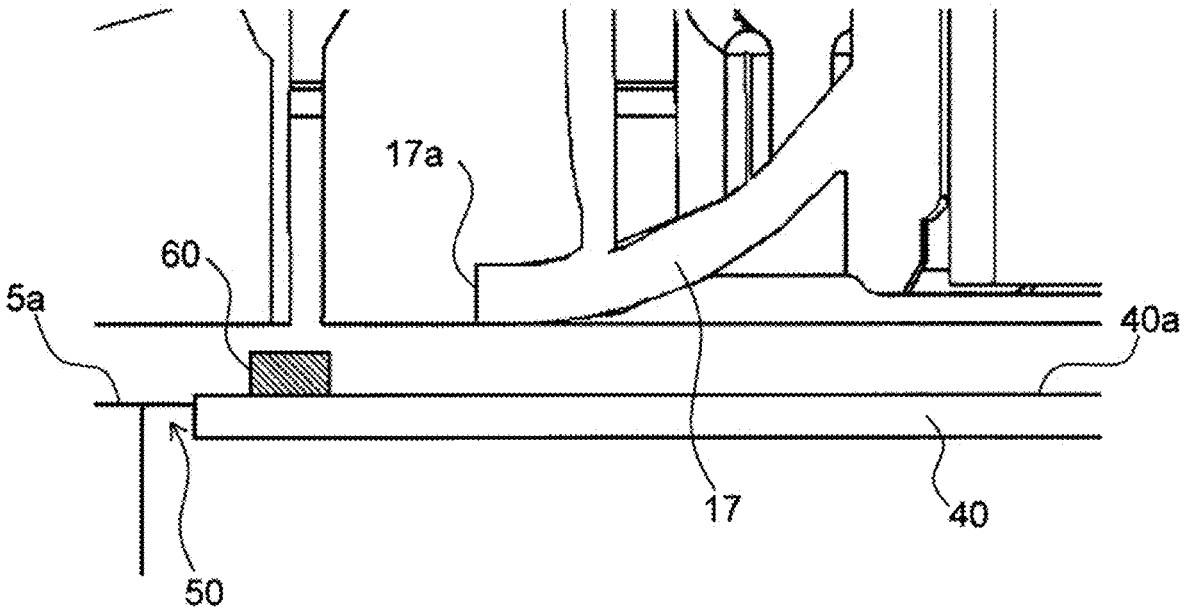
FIG. 8 is an enlarged partial cross-sectional view of an impeller and a circuit board according to at least one embodiment of the present disclosure.

FIG. 8 is an enlarged cross-sectional view of a portion of the impeller 10 opposes the circuit board 40 according to at least one embodiment of the present disclosure. In the circuit board 40, an electronic component 60 is mounted at a position further outside in the radial direction than the radially outer edge 17*a* of the lower shroud 17. As a result, the electronic component 60 is arranged in the flow path of the airflow guided in the centrifugal direction along the lower shroud 17 and there is an air-cooling effect on the electronic component 60 due to the airflow. In particular, by arranging the electronic component 60 having a large calorific value at a position further outside in the radial direction than the radially outer edge 17*a*, the amount of heat dissipation from the electronic component 60 can be increased.

In addition, disposing the upper casing 2 above the upper shroud 15 suppresses disturbance of the airflow around the upper shroud 15 and improves the efficiency of the centrifugal fan 100.

At least one embodiment of the present disclosure can be used for a centrifugal fan used for a range hood fan, a ventilating fan for a duct, a heat exchanging unit, paper adsorption for a printing apparatus, or the like.

Features of the above-described embodiments and the modifications thereof may be combined appropriately as long as no conflict arises. While embodiments of the present disclosure have been described above, one of ordinary skill in the art would understand that variations and modifications will be apparent to those skilled in the art without departing from the scope and spirit of the present disclosure. The scope of the present disclosure, therefore, is to be determined solely by the following claims.

What is claimed is:

1. A centrifugal fan, comprising:

a motor that has a stator and a rotor rotatable with respect to the stator;

a circuit board electrically connected to the motor;

an impeller fixed to the rotor, wherein the impeller is configured to rotate together with the rotor, wherein the impeller includes:

a boss portion fixed to the rotor, a plurality of blade portions arranged at intervals in a circumferential direction on an outer peripheral surface of the boss portion, wherein each of the plurality of blade portions extends outward in a radial direction, an upper shroud connected to at least a first portion of each of the plurality of blade portions, and a lower shroud connected to at least a second portion of each of the plurality of blade portions, wherein the second portion is closer to the circuit board than the first portion;

a gap for conducting airflow across the circuit board, wherein the gap is defined between a surface of the second portion of each of the plurality of blade portions and a surface of the circuit board; and a casing that accommodates the motor, the impeller, and the circuit board, wherein the casing includes a lower casing recessed outward from the impeller in an axial direction, the lower casing comprises a board housing portion that accommodates the circuit board, the lower casing has a flange portion extending outward in the radial direction from an outer peripheral edge of the board housing portion, a lower end surface of each of the plurality of blade portions without the lower shroud overlaps both an upper surface of the flange portion and an upper surface of the circuit board in the axial direction, and the upper shroud overlaps both the upper surface of the flange portion and the upper surface of the circuit board in the axial direction.

2. The centrifugal fan according to claim 1, wherein a height of the upper surface of the flange portion in the axial direction is equal to or less than a height of the upper surface of the circuit board.

3. The centrifugal fan according to claim 2, wherein an inner edge of the flange portion in the radial direction and an outer edge of the circuit board in the radial direction oppose each other with a gap therebetween, and a space above the circuit board in the axial direction communicates with a space in the board housing portion located below the circuit board in the axial direction via the gap between the inner edge of the flange portion and the outer edge of the circuit board.

4. The centrifugal fan according to claim 1, wherein an outer edge of the lower shroud in the radial direction is further inward in the radial direction than an outer peripheral edge of the circuit board.

5. The centrifugal fan according to claim 4, wherein the lower shroud has an inclined portion, the inclined portion closest to a center of the centrifugal fan is farther from the lower casing than the inclined portion farthest from the center of the centrifugal fan.

6. The centrifugal fan according to claim 5, wherein the lower shroud has a flat portion outside the inclined portion in the radial direction and extending along a plane perpendicular to the axial direction, wherein the flat portion is integral with the inclined portion.

7. The centrifugal fan according to claim 6, wherein the outer edge of the lower shroud in the radial direction is located at a same position in the radial direction as an inner edge of the upper shroud in the radial direction.

8. The centrifugal fan according to claim 6, wherein the outer edge of the lower shroud is located closer to the center of the centrifugal fan in the radial direction than an inner edge of the upper shroud.

9. The centrifugal fan according to claim 1, wherein an electronic component is on the circuit board at a position farther from a center of the centrifugal fan than an outer edge of the lower shroud in the radial direction.

10. The centrifugal fan according to claim 1, wherein the casing comprises an upper casing covering an upper side of the impeller in the axial direction, and the upper casing has an intake port opposing a central portion of the impeller in the radial direction.

11. The centrifugal fan according to claim 1, wherein the lower end surface of each of the plurality of blade portions comprises a lowermost surface of said each of the plurality of blade portions, and the lowermost surface overlaps both the upper surface of the flange portion and the upper surface of the circuit board in the axial direction, and extends in the radial direction across an entirety of a gap between an inner edge of the flange portion and an outer edge of the circuit board.

12. A centrifugal fan, comprising:

a motor;

a circuit board electrically connected to the motor;

an impeller fixed to the motor, wherein the motor is configured to rotate the impeller, wherein the impeller includes:

a plurality of blade portions arranged at intervals in a circumferential direction, an upper shroud connected to at least a first portion of each of the plurality of blade portions, and a lower shroud connected to at least a second portion of each of the plurality of blade portions, wherein the second portion is closer to the circuit board than the first portion; and a casing that accommodates the motor, the impeller, and the circuit board, wherein the casing includes a lower casing recessed outward from the impeller in an axial direction, the lower casing comprises a board housing portion that accommodates the circuit board, the impeller is configured to direct an airflow across a top surface of the circuit board in the board housing portion, the lower casing has a flange portion extending outward in the radial direction from an outer peripheral edge of the board housing portion, a lower end surface of each of the plurality of blade portions without the lower shroud overlaps both an upper surface of the flange portion and an upper surface of the circuit board in the axial direction, and the upper shroud overlaps both the upper surface of the flange portion and the upper surface of the circuit board in the axial direction.

13. The centrifugal fan according to claim 12, wherein the plurality of blade portions is integral with the upper shroud and the lower shroud.

14. The centrifugal fan according to claim 13, wherein an outer edge of the lower shroud is closer to the lower casing than an inner edge of the lower shroud.

15. The centrifugal fan according to claim 12, wherein an outer edge of the lower shroud is closer to a center of the centrifugal fan than an outer edge of the circuit board.

16. The centrifugal fan according to claim 12, wherein the lower end surface of each of the plurality of blade portions comprises a lowermost surface of said each of the plurality of blade portions, and the lowermost surface overlaps both the upper surface of the flange portion and the upper surface of the circuit board in the axial direction, and extends in the radial direction across an entirety of a gap between an inner edge of the flange portion and an outer edge of the circuit board.

* * * * *